United States Patent [19]

O'Loughlin

[11] Patent Number: 4,869,003

[45] Date of Patent: Sep. 26, 1989

[54] AUGER SNOWBLOWER

[76] Inventor: Howard O'Loughlin, 1413 13th St. S., Apt. 15, Great Falls, Mont. 59405

[21] Appl. No.: 226,448

[22] Filed: Aug. 1, 1988

[51] Int. Cl.[4] ..... E01H 5/09

[52] U.S. Cl. ..... 37/255

[58] Field of Search ..... 37/209–213, 37/238, 242, 244, 249, 250, 252, 254, 255, 257, 258, 261

[56] References Cited

U.S. PATENT DOCUMENTS

| | | | |
|---|---|---|---|
| 1,623,910 | 4/1927 | Curtis | 37/255 |
| 1,701,787 | 2/1929 | Messlin | 37/250 |
| 2,103,514 | 12/1937 | Cole . | |
| 2,269,326 | 1/1942 | Wandscheer . | |
| 2,278,220 | 3/1942 | Sicard | 37/255 |
| 2,719,368 | 10/1955 | Snook . | |
| 2,777,217 | 1/1957 | Klauer | 37/250 |
| 2,882,620 | 4/1959 | MacDonald . | |
| 3,503,450 | 3/1970 | Day | 37/257 |
| 3,721,025 | 3/1973 | Orr . | |
| 3,740,874 | 6/1973 | Boschung | 37/257 |
| 4,100,687 | 7/1978 | Jeswine . | |
| 4,158,923 | 6/1979 | Steiner et al. . | |
| 4,184,274 | 1/1980 | Vohl . | |
| 4,391,052 | 7/1983 | Guy, Jr. . | |
| 4,651,452 | 3/1987 | Husso | 37/249 |

FOREIGN PATENT DOCUMENTS

| | | | |
|---|---|---|---|
| 454349 | 1/1949 | Canada | 37/213 |

*Primary Examiner*—Eugene H. Eickholt

[57] ABSTRACT

An auger snowblower having outwardly disposed blowers and horizontally mounted dual augers rotating to move snow outwardly to the blower inlets is disclosed. Rotatable discharge chutes powered by hydraulically actuated cylinders is also disclosed. The dual augers and dual blowers are powered by hydraulic motors connected in series with a unitary hydraulic pump.

1 Claim, 4 Drawing Sheets

AUGER SNOWBLOWER

BACKGROUND OF THE INVENTION

1. Field of the Invention.

This invention relates to an auger snowblower and in particular an auger snowblower having dual discharge chutes in which the blower and augers are powered by hydraulic motors.

2. Discussion of the Technical Problems.

Conventional auger-type snowblowers generally power the auger by the use of belts, chains, pulleys, and direct mechanical drives. Additionally, conventional auger snowblowers are designed so that the snow is augered toward a centrally located snowblower which has a discharge chute that can be directed from side to side. Unfortunately, auger snowblowers of this type are difficult to mount on a vehicle because they require extensive mechanical connections. Additionally, they do not have sufficient power to force all of the snow through the snowblower when encountering heavy drifts and wet snow.

Snowblowers having outside mounted multiple blowers are not previously known in that the prior art teaches movement of snow along the auger toward the center where a single snowblower discharges the snow. By moving the snow outward in the auger to outside mounted blowers, a greater volume of snow can be moved from the auger and thus discharged at a higher rate. Ideally, double augers arranged vertically one on top of the other could be powered by two hydraulic motors. The augers would move the snow outward toward a pair of outwardly disposed blowers also each powered by a single hydraulic motor. Each blower is powered by its own motor.

The use of hydraulic motors to power a snowblower and a snow moving auger is shown in U.S. Pat. No. 4,381,052 issued July 5, 1983, to Guy, Jr. The Guy snowblower utilizes hydraulic motors to power the auger and the blower as well as to rotate the discharge chute. The snowblower of that design does not utilize multiple blowers located to the outside of the auger and the Guy invention teaches the conventional auger arrangement which transports the snow to the center for introduction into the snowblower instead of outwardly toward outside-mounted blowers.

Other snowblowers and snowplows with auger arrangements are known. Examples of such blowers and snowplows can be found in U.S. Pat. No. 2,719,368 issued Oct. 4, 1955, to Snook, U.S. Pat. No. 2,882,620 issued Apr. 21, 1959, to MacDonald, U.S. Pat. No. 4,100,687 issued July 18, 1978, to Jeswine, U.S. Pat. No. 2,103,514 issued Dec. 28, 1937, to Cole, U.S. Pat. No. 3,721,025 issued Mar. 20, 1973, to Orr, and U.S. Pat. No. 2,269,326 issued Jan. 6, 1942, to Wandscheer. A multiple snow discharge chute assembly is found in U.S. Pat. No. 4,158,923, issued June 25, 1979, to Steiner, et al. and an injection tube assembly for a snowblower is found in U.S. Pat. No. 4,184,274 issued Jan. 22, 1980, to Vohl.

Very few devices in the known art relate to multiple snowblowers and none known are directed to providing dual augers powered by hydraulic motors which move the snow to the outside where two hydraulically powered snowblowers discharge the snow through hydraulically controlled discharge spouts.

Accordingly, a need exists for a snowblower that would provide a safe, convenient power and snowblowing arrangement that is simple, inexpensive, and could be adapted to connection to a vehicle's hydraulic system. An auger snowblower of that type would provide a simple design, be easy to maintain, easily repaired, not subject to damage by proper use, and simple to manufacture. The instant invention is directed to all those needs as well as to others as explained in the following summary.

SUMMARY OF THE INVENTION

It is a feature of the invention to provide a snowblower for removing snow from roadways, parking lots, driveways, and the like.

It is another feature of the instant invention to provide a snowblower which is powered by hydraulic motors and is conveniently attached to a prime mover such as a pickup truck, automobile, jeep, or the like.

It is another feature of the instant invention to provide an auger snowblower having multiple augers which move the snow toward outwardly disposed blowers.

These and other features and obtained according to the instant invention by providing dual auger snowblower for attachment to a motor vehicle having closed augers which are powered by hydraulic motors located in the center of the augers. The augers are mounted one on top of the other and rotate through bearings. High speed blowers are located at the outside of the plow. The blowers are powered by hydraulic motors. Discharge chutes, which can be conveniently operated from inside the cab through hydraulic means, are also provided for rapid discharge of the snow. The device adaptes to connection to a vehicle and does not extend forward of the vehicle to any great depth.

BRIEF DESCRIPTION OF THE DRAWINGS

The advantages of this invention will become apparent upon consideration of the following detailed disclosure of the invention, especially when taken in conjunction with the accompanying drawings, wherein.

DESCRIPTION OF THE PREFERRED EMBODIMENT

Figure 1:
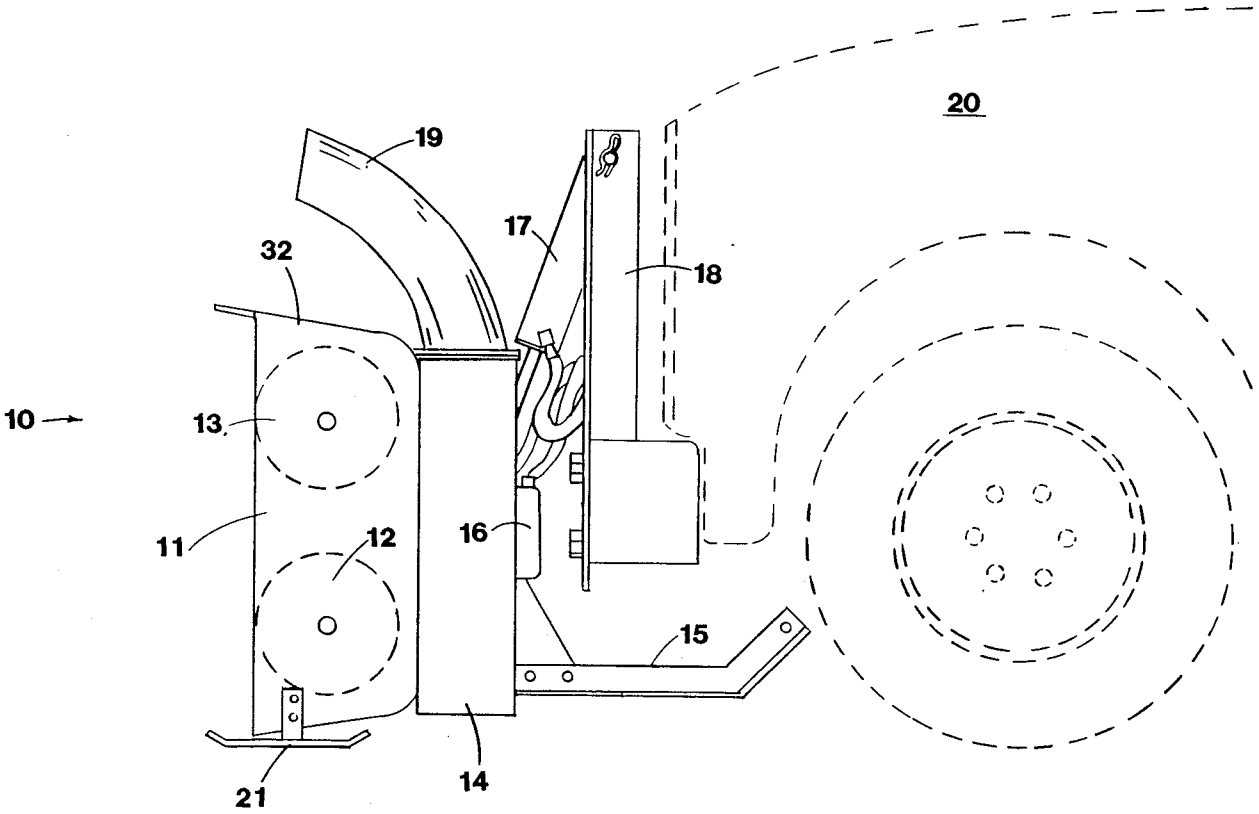
FIG. 1 is a side elevational view of the auger snowblower shown attached to the front of a vehicle in accordance with the present invention.

The auger snowblower apparatus of the instant invention is depicted generally in FIG. 1 at numeral 10. As can be seen by reference to FIG. 1, the invention 10 provides a snow blower having dual augers 12 and 13 which are arranged vertically within auger plow housing 11. Lower auger 12 is positioned in front of blower housing 14 and slightly beneath its center axis while upper auger 13 is positioned in front of blower housing 14 and above the blower axis. As can be seen by reference to FIG. 1, the auger snowblowe 10 of the instant invention is also provided with discharge chutes 19, blower motor 16, vehicle lower attachment 15, and vehicle upper attachment 18. Vehicle 20 could be any prime mower to include a pickup, an automobile, a jeep, or even a riding lawn mower. Hydraulic cylinder 17 is attached between upper vehicle frame 18 and auger snowblower 10 so that by actuation of the hydraulic cylinder 17 blower 10 can be raised and lowered as needed.

Figure 2:
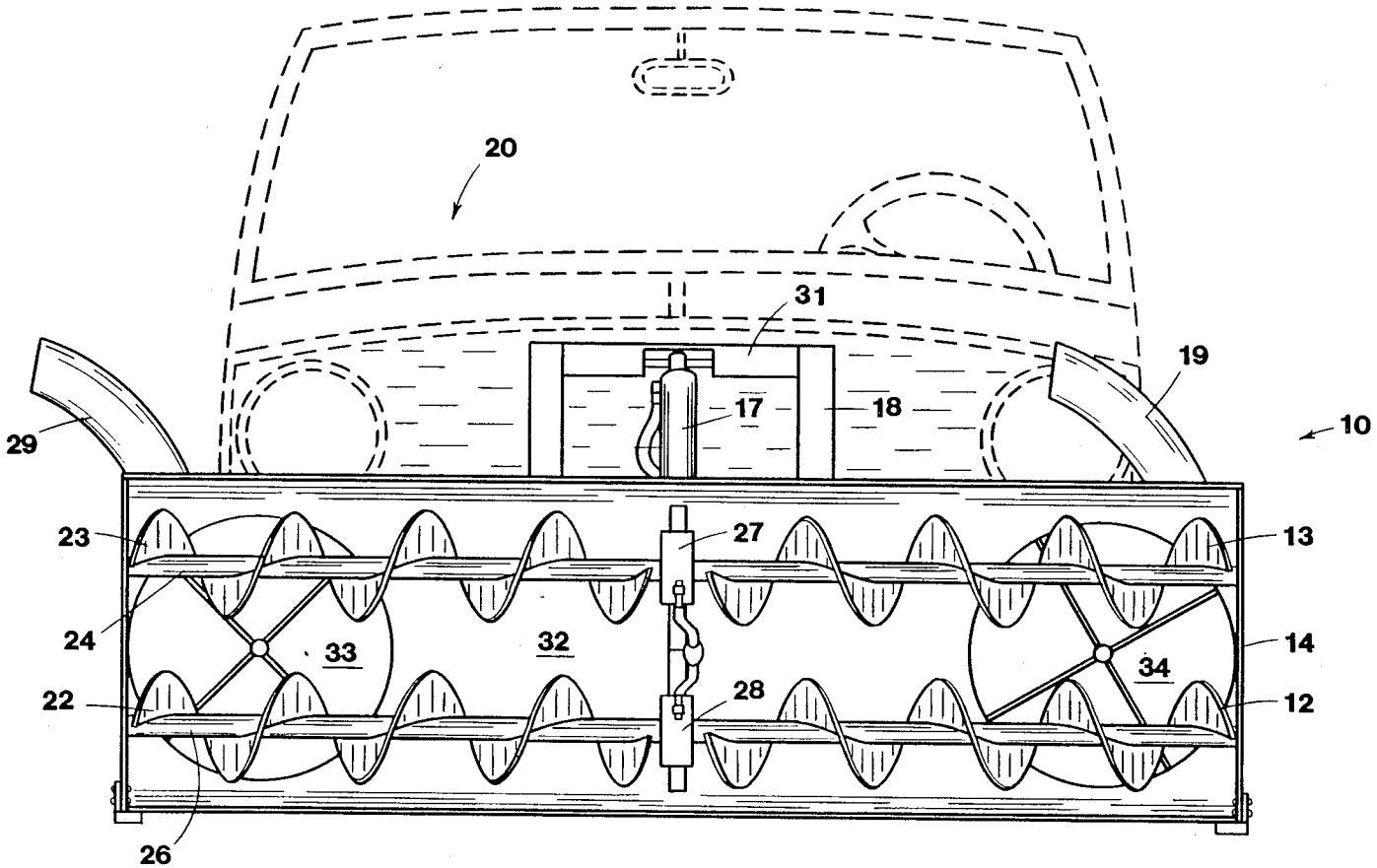
FIG. 2 is a front elevational view of the auger snowblower depicting the augers and the discharge chutes in position mounted in front of the vehicle.

With reference to FIG. 2, it can be seen that augers 12, 13, 22, and 23 are provided such that they rotate upon auger shafts 24 and 26 and the augers are enclosed rather than bale-type augers. The enclosed augers are arranged so that when rotating any snow would be moved outwardly toward snowblowers 33 and 34 where it could be discharged through discharge chutes 19 and 29. Augers 13 and 23 which are attached to shaft 24 are powered by hydraulic motor 27 which is connected in series ot hydraulic motor 28 rotating shaft 26 to power augers 12 and 22. With reference to FIG. 2, it can be seen that discharge chutes 19 and 29 are so arranged that they discharge to one side or the other as needed and can be controlled from inside the vehicle 20.

Figure 3:
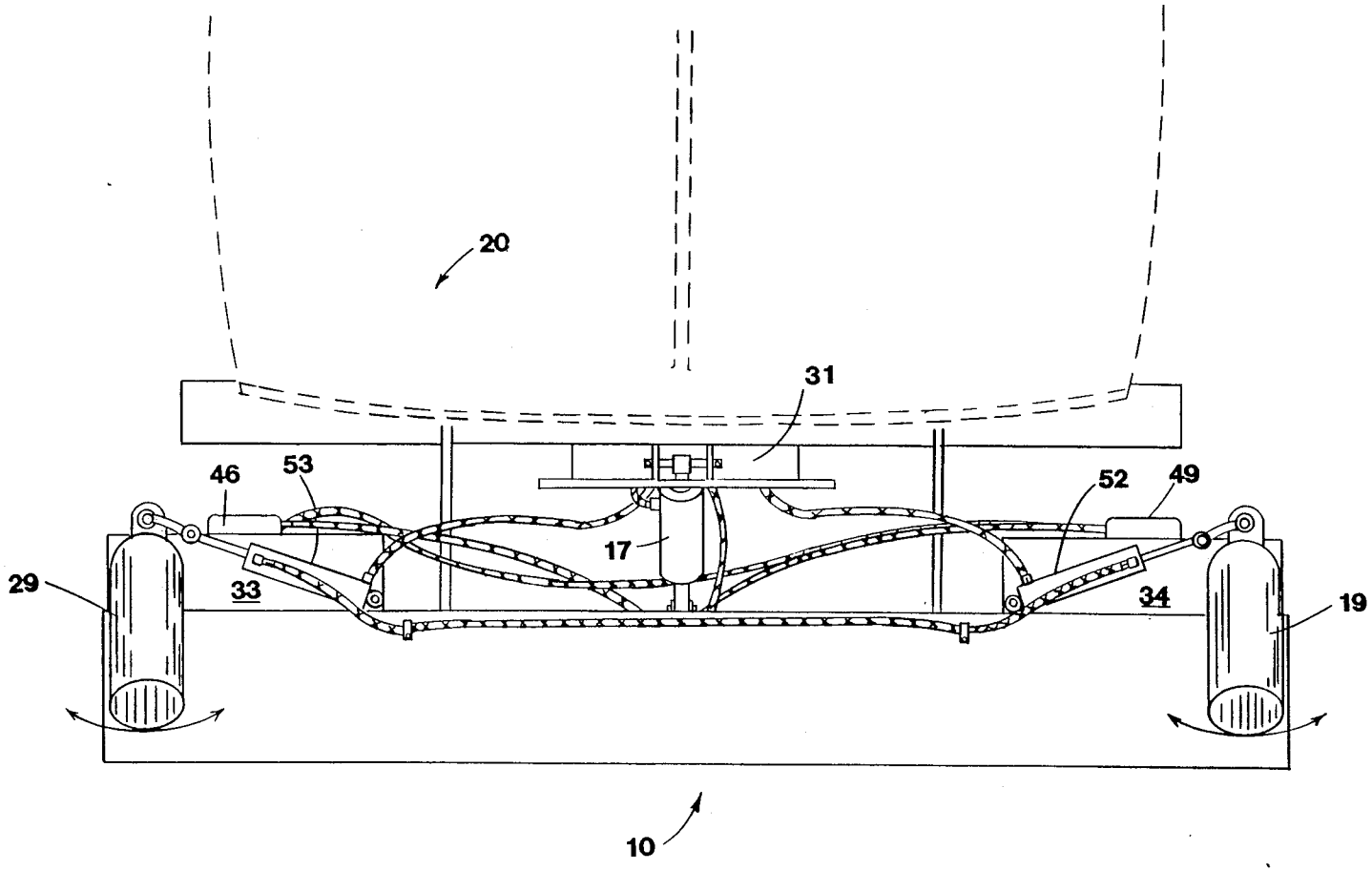
FIG. 3 is a top plan view of the auger snowblower in accordance with the present invention.

With reference to FIG. 3, it can be seen that discharge chutes 19 and 29 are moved about by hydraulic cylinders 52 and 53 so that the chutes 19 and 29 move in a parallel fashion from one side to the other side as operably selected by the operator. It can also be seen by reference to FIG. 3 that hydraulic motors 46 and 49 power snowblowers 33 and 34.

Figure 4:
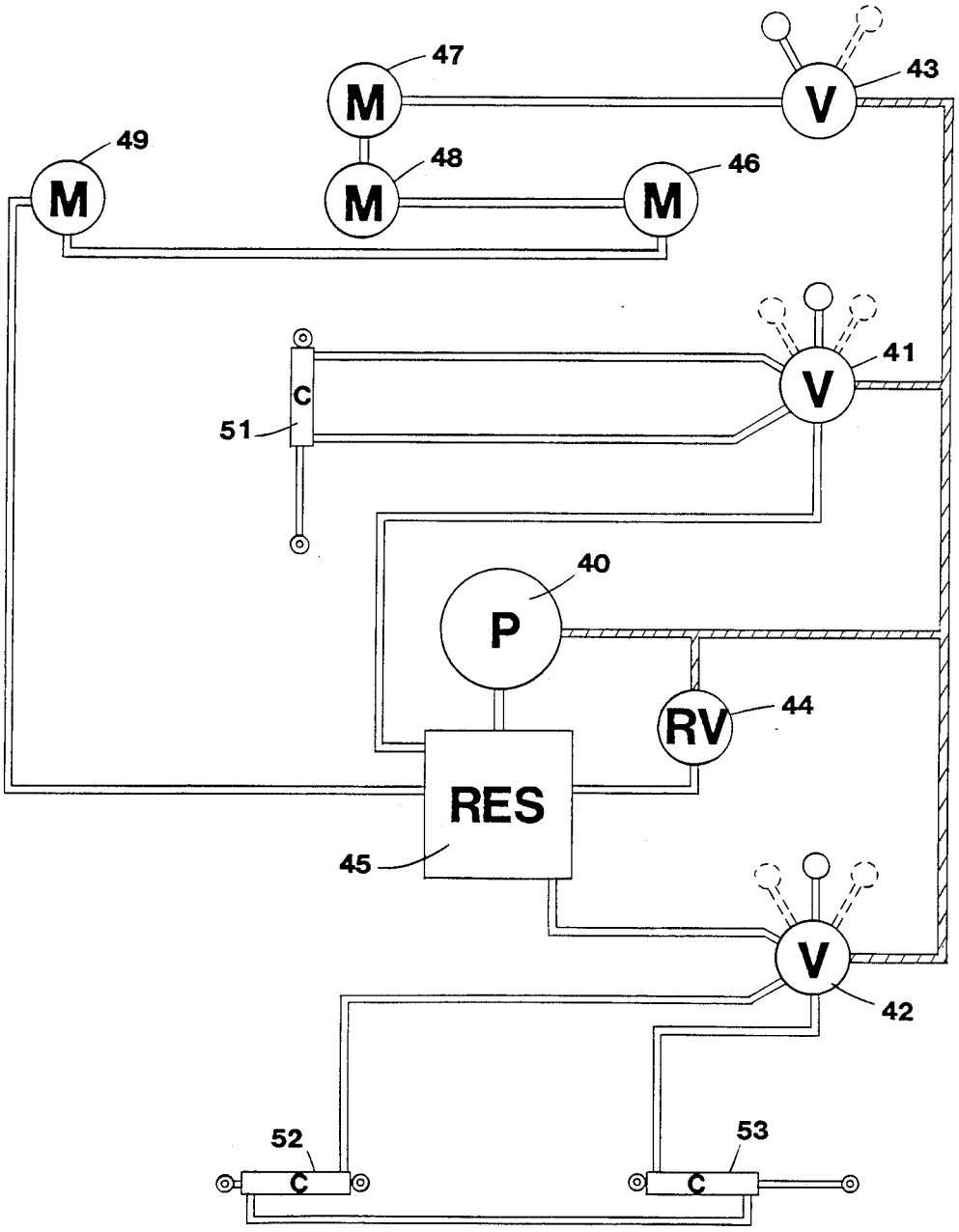
FIG. 4 is a block view of the hydraulic connections showing that a single pump can control all of the hydraulic motors and cylinders needed for successful operation of the invention.

Now with reference to FIG. 4 where the hydraulic pump and hose connections are depicted, it can be seen that from a single hydraulic pump 40 double acting valve 43 is provided to activate hydraulic motors 47 and 48 which run auger shafts 24 and 26 to power the augers and hydraulic motors 46 and 49 power the snowblowers 33 and 34 that when pump 40 is providing hydraulic pressure and valve 43 is in an on position that motors 46, 47, 48, and 49 are actuated, thus providing power to the augers and the blowers. Selectible valve 41 is provided with a three position hydraulic valve to actuate hydraulic lifting cylinder 51 to raise and lower plow 10. cylinder 51 as depicted in FIG. 4 is the same as lifting cylinder 17 as depicted in FIG. 1. Additional valve 442 is provided with a three-way position so as to selectively actuate cylinders 53 and 52 as they are arranged in series to operate discharge chutes 19 and 26 in a parallel fashion, that is when cylinder 52 is in a retracted position, cylinder 53 is in extended position as depicted in FIG. 4. Conversely, when valve 42 is repositioned, cylinder 52 is extended and cylinder 53 is retracted, thus keeping dischrage chutes 19 and 26 in proper alignment. As can be noted from FIG. 4, the entire auger snowblower 10 of the invention is powered by a single hydraulic pump 40 and three valves as well as a release valve 44 and reservoir 45. The controls are quite simple since to actuate all the blowers and the augers, valve 43 only has to be positioned to an on position with the raising and lowering of the auger snowblower 10 can be controlled by valve 41 having an up and down position and the control of the discharge chute 19 and 26 can be controlled by valve 42 and 42, thus providing a simple convenient easily adapted selection of operations through the three valves controlling the auger snowblower.

Although specific applications, materials, components, connections, sequences of events, and methods have been stated in the above description of the preferred embodiment of the invention, other suitable materials, other applications, components and process steps as listed herein may be used with satisfactory results and varying degrees of quality. In addition, it will be understood that various other changes in details, materials, steps, arrangements of parts and uses which have been herein described and illustrated in order to explain the nature of the invention will occur to and may be made by those skilled in the art, upon a reading of this disclosure, and such changes are intended to be included within the principles and scope of this invention as hereinafter claimed.

I claim:

1. A dual auger snowblower comprising:

a frame means adapted for connection to a prime mover;

a housing means;

a first lower horizontal rotating auger mounted within said housing means;

a second upper horizontal rotating auger mounted within said housing means;

a pair of snowblower fans mounted outwardly from the center of said housing means and attached to said housing means;

a pair of discharge chutes attached to said housing means in pneumatic communication with said dual snowblower fans;

a lifting means attached between said frame means and said housing means for lifting said housing means;

a lifting means comprised of a hydraulic cylinder;

said first lower and said second upper augers are connected in operative association to a first lower hydraulic motor and a second upper hydraulic motor for turning said augers respectively;

said first lower hydraulic motor and said second upper hydraulic motor attached to said augers are attached substantially medial along said augers;

said dual snowblower fans are each powered by a hydraulic motor in opperative association.

* * * * *